US008768236B2

(12) United States Patent
Jung

(10) Patent No.: US 8,768,236 B2
(45) Date of Patent: Jul. 1, 2014

(54) DUPLEX IMAGE FORMING APPARATUS

(75) Inventor: Seung Bok Jung, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 718 days.

(21) Appl. No.: 12/041,068

(22) Filed: Mar. 3, 2008

(65) Prior Publication Data

US 2008/0240822 A1 Oct. 2, 2008

(30) Foreign Application Priority Data

Mar. 26, 2007 (KR) ..... 10-2007-0029471

(51) Int. Cl.
*G03G 15/00* (2006.01)

(52) U.S. Cl.
USPC ..... 399/401; 399/397; 399/405

(58) Field of Classification Search
USPC ..... 399/401, 405, 397, 388; 271/225
See application file for complete search history.

(56) References Cited

U.S. PATENT DOCUMENTS 5,132,742 A * 7/1992 Goto ..... 399/401
5,449,160 A * 9/1995 Hou et al. ..... 271/3.15
5,485,990 A * 1/1996 Kato ..... 271/9.08
6,041,213 A * 3/2000 Yanagi ..... 399/401
6,926,272 B2 * 8/2005 Carter et al. ..... 271/258.01
7,379,702 B2 * 5/2008 Kim ..... 399/401
2004/0091281 A1 * 5/2004 Kimizuka ..... 399/92
2005/0254846 A1 * 11/2005 Yura et al. ..... 399/67

FOREIGN PATENT DOCUMENTS

KR 1020010100816 11/2001
KR 2005-7904 1/2005
KR 1020050110060 11/2005

OTHER PUBLICATIONS

Korean Office Action dated Jun. 17, 2013 issued in KR Application No. 10-2007-0029471.

* cited by examiner

*Primary Examiner* — Matthew G Marini
(74) *Attorney, Agent, or Firm* — Stanzione & Kim, LLP

(57) ABSTRACT

A duplex image forming apparatus includes a driving unit which has driving rollers and driven rollers to reversely feed the paper printed on the first surface to a duplex printing part or discharge the paper printed on the first and second surfaces, and a separation unit which separates the driven rollers from the driving rollers while the paper printed on the first surface is reversely fed and registered by duplex rollers of the duplex printing part. Accordingly, when the paper is registered by the duplex rollers, because the paper is not caught in the driving rollers and the driven rollers, the paper can be easily registered.

10 Claims, 5 Drawing Sheets

DUPLEX IMAGE FORMING APPARATUS

CROSS-REFERENCE TO RELATED APPLICATIONS

This application claims the priority benefit under 35 U.S.C. §119(a) of Korean Patent Application No. 2007-0029471, filed on Mar. 26, 2007 in the Korean Intellectual Property Office, the disclosure of which is incorporated herein by reference in its entirety.

BACKGROUND OF THE INVENTION

1. Field of the Invention

The present general inventive concept relates to an image forming apparatus, and more particularly, to a duplex image forming apparatus which is capable of printing both surfaces of a printing medium, e.g., paper.

2. Description of the Related Art

An image forming apparatus is an apparatus that prints an image on a printing medium, e.g., paper, according to an inputted image signal. An image forming apparatus is classified as a simplex image forming apparatus which prints only one surface (front surface) of paper, or a duplex image forming apparatus which also prints a rear surface of paper by reversing the paper after printing a front surface.

The duplex image forming apparatus generally includes a paper supplying part to supply the paper, an image forming part to form an image on the supplied paper, and a paper discharge part to discharge the printed paper having passed through the image forming part to the outside.

The duplex image forming apparatus further includes a duplex printing part which is provided with duplex rollers so as to feed again the paper, whose front surface has been printed, to the image forming part to print a rear surface of the paper.

The duplex printing part rotates the duplex rollers to feed again the paper, which is fed by the reverse rotation of discharge rollers provided in the paper discharge part, to the image forming part. Accordingly, the paper whose front surface has been printed is fed again to the image forming part via a duplex print path, and the rear surface of the paper is printed.

The duplex rollers have a function of registering the paper fed by the duplex rollers, as well as reversely feeding the paper whose front surface has been printed.

However, because a portion of the paper fed by the duplex rollers is also caught in the discharge rollers, it is not easy for the duplex rollers to register to the paper by the discharge rollers.

For instance, the conventional duplex image forming apparatus includes center-feed type discharge rollers which are disposed at positions corresponding to a center portion of the paper, and side-feed type duplex rollers which are disposed at positions corresponding to sides of the paper. The duplex rollers are typically set to register the paper at the positions corresponding to the sides of letter paper.

Because the duplex rollers register the paper at the positions corresponding to the sides of the letter paper, in order to register the A4 paper, the paper should be shifted by a predetermined distance, e.g., 3 mm or more, in a transverse direction of the paper. However, because an end portion of the paper which is registered by the duplex rollers is caught in the discharge rollers, it is difficult to register the paper.

SUMMARY OF THE INVENTION

The present general inventive concept provides a duplex image forming apparatus that is capable of easily performing a paper registering process of duplex rollers in a duplex printing operation.

Additional aspects and/or advantages of the general inventive concept will be set forth in part in the description which follows and, in part, will be obvious from the description, or may be learned by practice of the general inventive concept.

The foregoing and/or other aspects and utilities of the present general inventive concept may be achieved by providing a duplex image forming apparatus, including an image forming part which forms an image on paper, a paper discharge part which reversely feeds the paper, in which the image has been formed on a first surface of the paper in the image forming part, so that the image is formed on a second surface of the paper, or discharges the paper on which the image is completely formed, and a duplex printing part which is provided with duplex rollers which feed the paper reversed from the paper discharge part toward the image forming part to form the image on the second surface of the paper, and register the paper fed to form the image on the second surface. The paper discharge part includes a driving unit which has driving rollers and driven rollers to reversely feed the paper printed on the first surface to the duplex printing part or discharge the paper printed on the first and second surfaces, and a separation unit which separates the driven rollers and the driving rollers from each other while the paper is registered by the duplex rollers.

The paper discharge part may further include a first supporting frame to which the driving rollers are mounted, and a second supporting frame which is provided below the first supporting frame and to which the driven rollers are mounted. The first supporting frame and the second supporting frame provide a paper feeding path therebetween.

The separation unit may include a cam member which is provided underneath the second supporting frame, a rotating shaft which is connected to the cam member, and a rotating motor which rotates the rotating shaft. The second supporting frame pivots by the separation unit so that the driven rollers are separated from the driving rollers.

The second supporting frame may be hingedly coupled to the first supporting frame so as to pivot when the cam member rotates.

The duplex printing part may further include a duplex sensor which detects that the paper is fed by the duplex rollers, and when the duplex sensor detects that the paper is fed by the duplex rollers, the rotating motor of the separation unit operates.

The separation unit include a cam member which is provided underneath the second supporting frame, a rotating shaft which is connected to the cam member, and a gear member provided to be connected to the rotating shaft and receiving rotational force from a driving source which drives overall the image forming part, the paper discharge part and the duplex printing part. The second supporting frame may pivot by the separation unit so that the driven rollers are separated from the driving rollers.

The foregoing and/or other aspects and utilities of the present general inventive concept may be achieved by providing a duplex image forming apparatus, including an image forming part which forms an image on paper, a paper discharge part to discharge the paper in a discharging direction and to feed the paper in a reverse direction, and a duplex printing part to receive the paper from the paper discharge part in the reverse direction, and to register the paper when feeding the paper toward the image forming part, wherein the paper discharge part stops feeding the paper when the duplex printing part registers the paper.

The paper discharge part may include a driving roller to contact the paper to feed the paper in the reverse direction, and not to contact the paper to stop feeding the paper in the reverse direction when a portion of the paper is registered by the duplex printing part.

The paper discharge part may include a driving roller and a driven roller to feed the paper in the reverse direction, and to stop feeding the paper when a portion of the paper is registered by the duplex printing part.

The paper discharge part may include a driving roller and a driven roller to form a paper feeding path therebetween and to feed the paper in the reverse direction through the paper feeding path, and at least one of the driving roller and the driven roller moves away from the paper feeding path when the paper is registered by the duplex printing part.

The paper discharge part may include a driving roller disposed in a first position to feed the paper in the reverse direction, the paper may include a first paper having a first size and a second paper having a second size, and the driving roller may move to a second position from the first position when the first paper is registered by the duplex printing part and may not move to the second position from the first portion when the second paper is registered by the duplex printing part.

The driving roller may be spaced-apart from the duplex printing part by a distance different from the first size and the second size.

The distance between the driving roller and the duplex printing part may be longer than the second size and shorter than the first size.

The paper discharge part may further include a first supporting frame having a driving roller rotatably mounted thereon, and a second supporting frame having a driven roller rotatably mounted thereon to form a paper feeding path therebetween, and at least one of the first supporting frame and the second supporting frame may move to separate one of the driving roller and the driven roller from the paper when the paper is registered.

The paper may include first and second end portions opposite to each other in the reverse direction, and the paper discharge part may be separated from the first end portion when the duplex printing part registers the paper by feeding the second end portion of the paper.

The paper discharge part may selectively stop feeding the paper according to a size of the paper in the reverse direction.

The foregoing and/or other aspects and utilities of the present general inventive concept may be achieved by providing a duplex image forming apparatus, including an image forming part which forms an image on a first paper having a first size and a second paper having a second size, a paper discharge part disposed in a first position to discharge the first paper and the second paper in a discharging direction and to feed the first paper and the second paper in a reverse direction, and a duplex printing part to receive the first paper and the second paper from the paper discharge part in the reverse direction, and to register the first paper and the second paper when feeding the first paper and the second paper toward the image forming part, wherein the paper discharge part moves to a second position from the first position not to feed the first paper in the reverse direction when the first paper is registered by the duplex printing part, and does not move to the second position when the second paper is registered by the duplex printing part.

The first size may be longer than the first size in the reverse direction.

The paper discharge part may include a driving roller to feed the first paper and the second paper in the reverse direction, the duplex printing part may include a register roller to register the first paper and the second paper during feeding the first paper and the second paper to the image forming part, and the driving roller may be spaced-apart from the register roller by a distance different from the first size and the second size.

The paper discharge part may not catch the first paper and the second paper when the duplex printing part registers the first paper and the second paper.

BRIEF DESCRIPTION OF THE DRAWINGS

These and/or other aspects and utilities of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
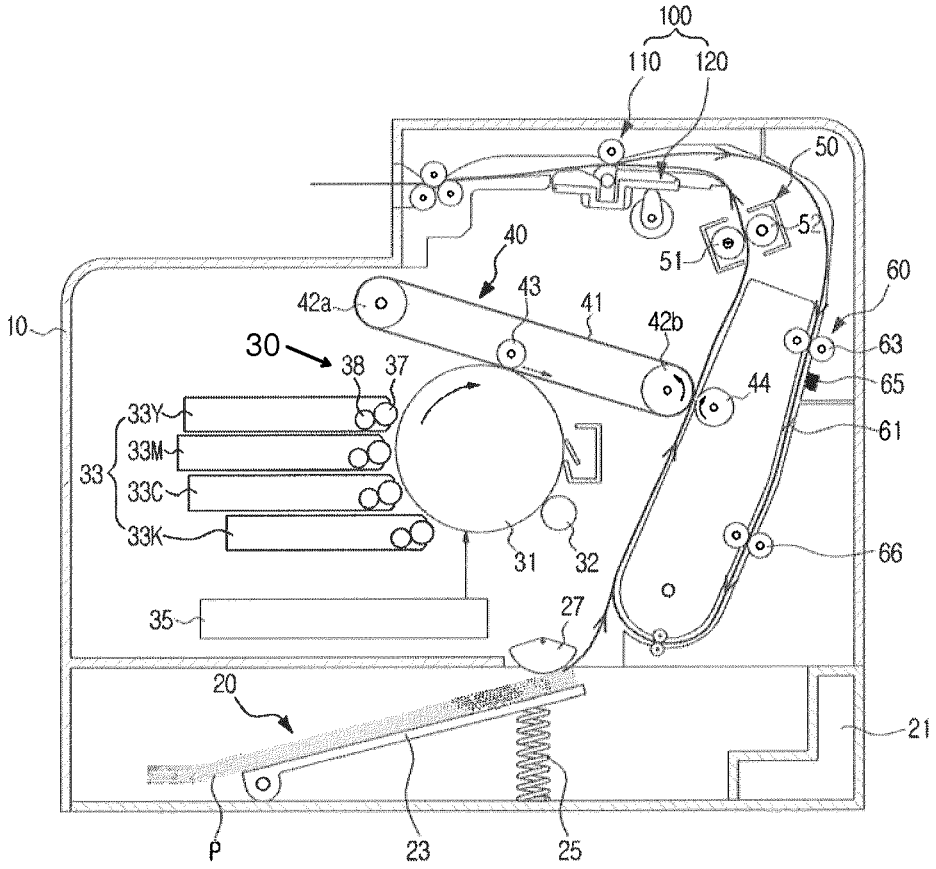
FIG. 1 is a sectional view illustrating a duplex image forming apparatus according to an exemplary embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a sectional view illustrating a duplex image forming apparatus according to an exemplary embodiment of the present general inventive concept.

As illustrated in FIG. 1, the duplex image forming apparatus includes a main body 10 which forms an exterior appearance, a paper supply part 20, an image forming part, a duplex printing part 60, and a paper discharge part 100. The paper supply part 20, the image forming part, the duplex printing part 60, and the paper discharge part 100 are provided inside the main body 10.

The paper supply part 20 includes a paper cassette 21 which is removably mounted in a lower portion of the main body 10, a paper supporting plate 23 which is pivotably coupled to the paper cassette 21 and on which printing media P, such as paper sheets, are stacked, an elastic member 25 which is provided under the paper supporting plate 23 and elastically supports the paper supporting plate 23 to bias the same upward, and a pickup roller 27 which is disposed at a position corresponding to a front end portion of the paper sheets stacked on the paper supporting plate 23 and picks up a sheet of paper.

The image forming part to form an image on the paper supplied from the paper supply part 20 includes a developing unit 30, a transfer unit 40, and a fusing unit 50.

The developing unit 30 includes a photosensitive body 31, a charge roller 32 which charges the photosensitive body 31 with a uniform electric potential, an exposure member 35 which irradiates a laser beam to the photosensitive body 31 to form an electrostatic latent image on the photosensitive body 31 charged by the charge roller 32, and developer cartridges 33 which supply developers to the electrostatic latent image formed on the photosensitive body 31 to transform the electrostatic latent image into a visible image.

The developer cartridges 33 are configured as four developer cartridges 33Y, 33M, 33C and 33K in which developers of different colors, e.g., yellow, magenta, cyan and black developers, are respectively stored. Each of the developer cartridges 33Y, 33M, 33C and 33K includes a developing roller 37 which develops the electrostatic latent image formed on the photosensitive body 31 by supplying the developer to the electrostatic latent image, and a supply roller 38 which rotates while contacting the developing roller 37 to supply the developer to the developing roller 37.

The transfer unit 40 includes an intermediate transfer belt 41 which is supported by supporting rollers 42*a* and 42*b* and runs at the same velocity as a rotational linear velocity of the photosensitive body 31, a first transfer roller 43 which is disposed opposite to the photosensitive body 31 with respect to the intermediate transfer belt 41 and transfers the visible image developed on the photosensitive body 31 onto the intermediate transfer belt 41, and a second transfer roller 44 which is disposed opposite to the intermediate transfer belt 41 with respect to a transferring of the paper and transfers the visible image transferred onto the intermediate transfer belt 41 onto the paper.

The fusing unit 50 fuses the visible image formed by the developing unit 30 to the paper by applying heat and pressure, and includes a heat roller 51 which contains a heat source, and a press roller 52 which is disposed opposite to the heat roller 51 and maintains the constant fusing pressure with the heat roller 51.

The duplex printing unit 60 feeds the paper printed on a front surface in a reverse direction so as to be subsequently printed on a rear surface thereof. The duplex printing unit 60 includes a duplex path 61, duplex rollers 63, 66 which are mounted on the duplex path 61 to feed the paper, and a duplex sensor 65 which detects the paper which is fed by the duplex rollers 63, 66.

The duplex rollers 63 have a function of feeding the paper printed on the front surface to the image forming part so as to be subsequently printed on the rear surface, and at the same time have a function of registering the fed paper as register rollers. The duplex rollers 63 are disposed at positions corresponding to the sides of the fed paper.

The duplex sensor 65 determines whether the paper is caught in the duplex rollers 63, and operates a separation unit 120 of the paper discharge part 100, which will be described later.

The paper discharge part 100 reversely feeds the paper, which is printed on the front surface in the image forming part, to the duplex printing part 60, and discharges the duplex-printed paper. The paper discharge part 100 feeds the paper in a feeding direction, so that the paper is discharged, and feeds the paper in a reverse direction opposite to the feeding direction, so that the paper is fed back to a printing path through the duplex path 61.

Figure 2:
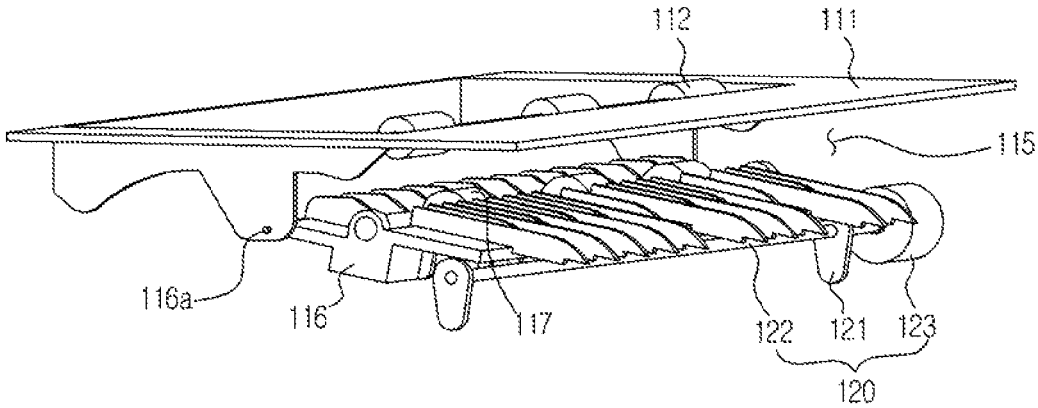
FIG. 2 is a perspective view illustrating a paper discharge part illustrated in FIG. 1.

As illustrated in FIGS. 1 and 2, the paper discharge part 100 includes a driving unit 110 which reversely feeds the paper printed on the front surface to the duplex printing part 60 or discharges the duplex-printed paper, and a separation unit 120 which makes the reversely fed simplex (front surface)-printed paper by the driving unit 110 to be easily registered by the duplex rollers 63.

The driving unit 110 includes a first supporting frame 111 to which driving rollers 112 are mounted, and a second supporting frame 116 which is provided below the first supporting frame 111 and to which driven rollers 117 are mounted to face the driving rollers 112. A paper feeding path 115 is provided between the first supporting frame 111 and the second supporting frame 116, to guide the paper when reversely feeding the paper printed on the front surface to the duplex printing part 60 or discharging the duplex-printed paper.

The separation unit 120 includes a cam member 121 which is mounted underneath the second supporting frame 116 while contacting the same, a rotating shaft 122 which is connected to the cam member 121, and a rotating motor 123 which rotates the rotating shaft 122. When the cam member 121 rotates about the rotating shaft 122 by the rotating motor 123, the second supporting frame 116 pivots by the cam member 121. In order for the second supporting frame 116 to pivot by the rotation of the cam member 121, an end of the second supporting frame 116 is hingedly coupled to the first supporting frame 111 through a shaft 116*a*.

Figure 5:
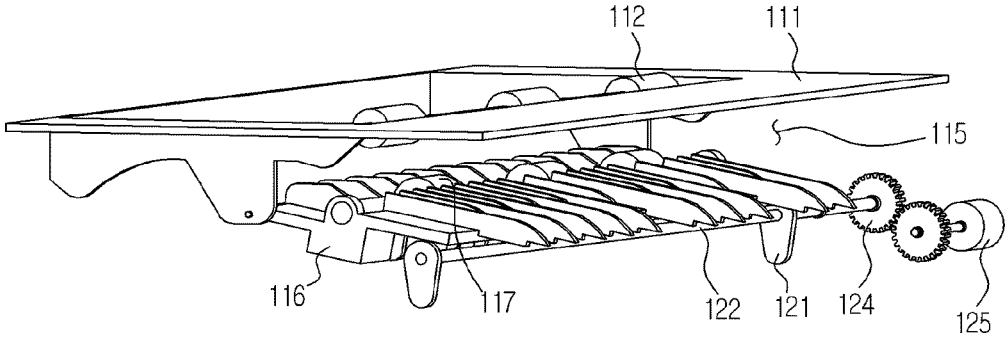
FIG. 5 is a perspective view illustrating a paper discharge part according to an exemplary embodiment of the present general inventive concept.

This embodiment describes that the rotating motor 123 is provided to rotate the rotating shaft 122 and the cam member 121 connected thereto. However, an exemplary embodiment, as illustrated in FIG. 5, may be modified such that a gear member 124 is provided to be connected to the rotating shaft 122 so as to receive the rotational force of a driving source 125 for driving the overall duplex image forming apparatus.

Hereinafter, an operation of the duplex image forming apparatus of FIGS. 1 and 2 according to an exemplary embodiment will be described with reference to FIGS. 3 and 4.

Figure 3:
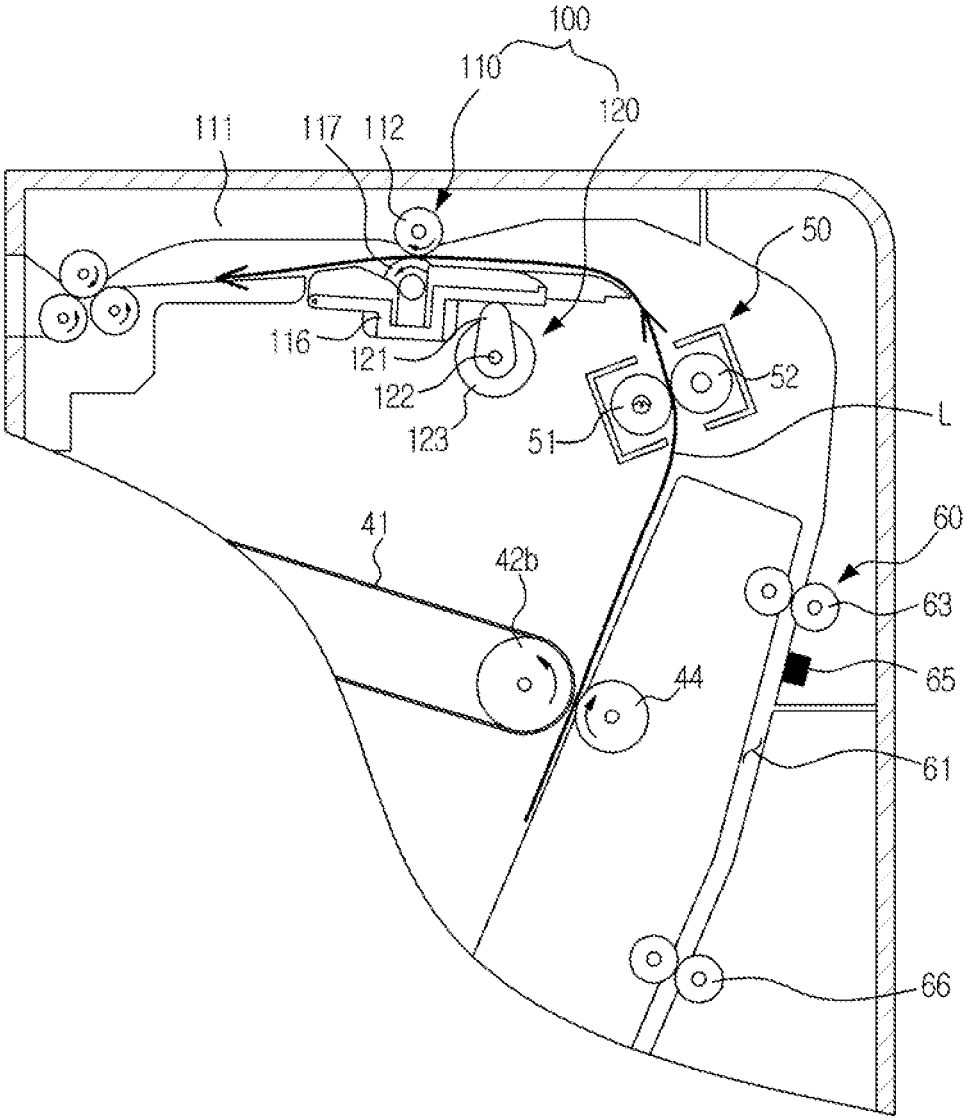
FIGS. 3 and 4 are views illustrating an operation of a duplex image forming apparatus according to an exemplary embodiment of the present inventive concept.

As illustrated in FIG. 3, the paper loaded on the paper supply part 20 is fed to the image forming part to form a visible image on the front surface of the paper. The paper printed on the front surface is fed to a region between the driving rollers 112 and the driven rollers 117 in the paper discharge part 100.

If the paper printed on the front surface is fed to the region between the driving rollers 112 and the driven rollers 117 by a predetermined extent or more, the driving rollers 112 rotate in the reverse direction to reversely feed the paper printed on the front surface to the duplex path 61 of the duplex printing part 60.

Figure 4:
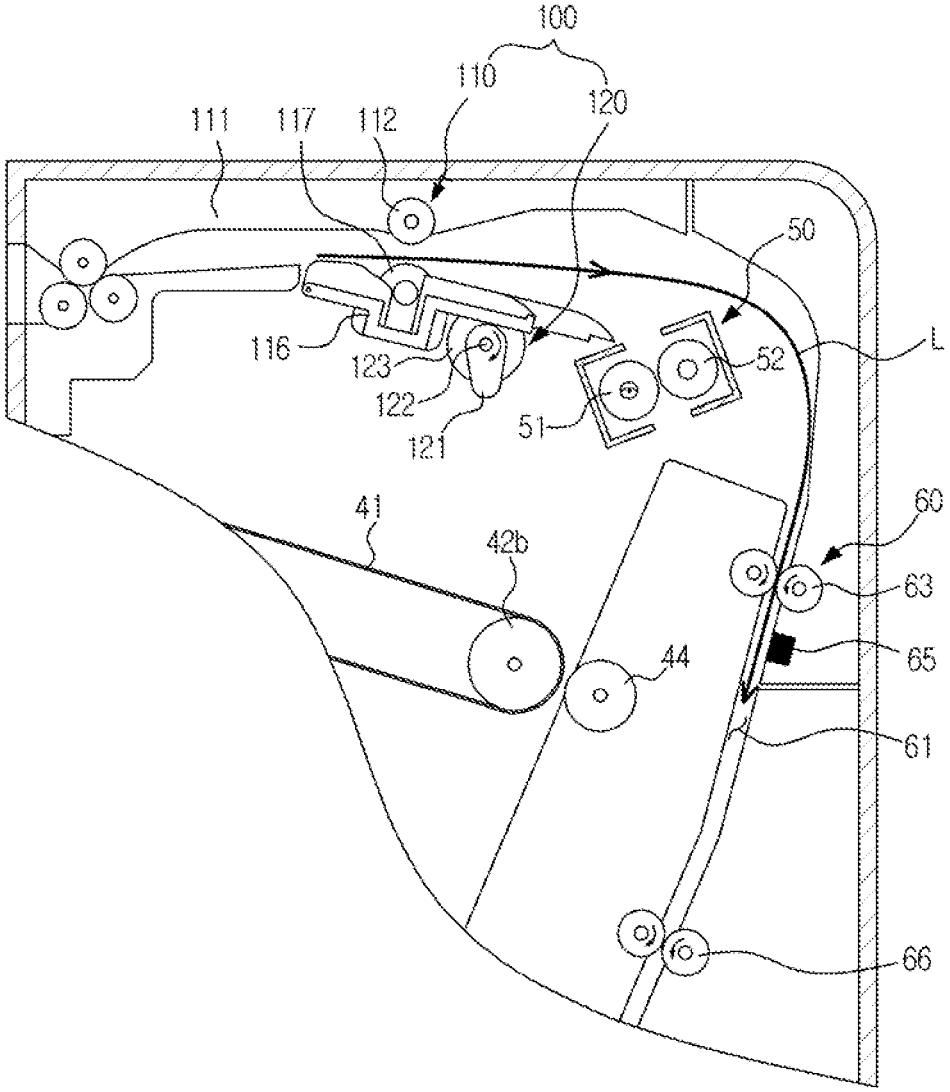

As shown in FIG. 4, the paper is fed to the duplex path 61 in a reversed direction and then fed back to the image forming part by the rotation of the duplex rollers 63, so that the image is formed on the rear surface of the paper. While being fed by the duplex rollers 63, the paper is registered to prevent twisting.

In the above process, the duplex sensor 65 of the duplex printing part 60 detects whether the paper is caught in the duplex rollers 63. If the duplex sensor 65 detects the paper caught in the duplex rollers 63, the duplex sensor 65 transmits a signal to the rotating motor 123 of the separation unit 120 to rotate the rotating motor 123. If the rotating motor 123 rotates, the rotational force of the rotating motor 123 is transmitted to the cam member 121 to separate the second supporting frame 116 from the first supporting frame 111. In other words, the driven rollers 117 mounted to the second supporting frame 116 are separated from the driving rollers 112 mounted to the first supporting frame 111.

As described above, since the driven rollers 117 are separated from the driving rollers 112 in the paper discharge part 100 in the process of registering the paper by the duplex rollers 63, the paper can be easily registered, when compared to a conventional apparatus in which the paper is caught in the driving rollers and the driven rollers while being registered.

Specifically, even when registering a sheet of paper, such as A4 size paper, by the duplex rollers of the duplex image forming apparatus, which are typically set for letter paper, since the paper is not caught in the paper discharge part, the paper can be easily registered.

When a first printing medium having a first size, such as the A4 size paper, is fed, a length L between the duplex roller 63 and a position between the driving roller 112 and the driven roller 117 may be shorter than a length of the sheet of the A4 size paper in the direction to feed the paper from the paper discharging part 100 to the duplex path 61. In this case, a leading edge (previously trailing edge) and a trailing edge (previously leading edge) of the A4 size paper fed in the reversed direction may contact the driving roller 112 and the duplex roller 63, respectively, for a period corresponding to a difference between the length L and the length of the A4 size paper. However, the driving roller 112 and the driven roller are separated immediately after the duplex roller 63 registers and feeds the A4 size paper. Accordingly, the driving roller 112 and the driven roller 117 do not interfere the registering operation of the duplex roller 63.

When the printing medium is a second printing medium having a second size different from the first size in a feeding direction, such as a letter size paper, is fed, the driving roller 112 and the driven roller 117 do not interfere the registering operation of the duplex roller 63 since the length L between the duplex roller 63 and a position between the driving roller 112 and the driven roller 117 may be equal or longer than a length of the sheet of the letter size paper in the direction to feed the paper from the paper discharging part 100 to the duplex path 61. It is possible that when the letter size paper is fed, the letter size paper can be registered by the duplex roller 63 without separating the driving roller 112 and the driven roller 117 to avoid interference of the driving roller 112 and the driven roller 117.

As apparent from the above description, the duplex image forming apparatus according to an exemplary embodiment can easily register the paper because when the paper is registered by the duplex rollers, the paper is not caught in the driving rollers and the driven rollers.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A duplex image forming apparatus, comprising:

an image forming part which forms an image on paper;

a paper discharge part which reversely feeds the paper, in which the image has been formed on a first surface of the paper in the image forming part, so that the image is formed on a second surface of the paper, and discharges the paper on which the image is completely formed; and a duplex printing part having duplex rollers located upstream of a duplex sensor to feed the paper reversed from the paper discharge part toward the image forming part to form the image on the second surface of the paper, and to register the paper fed to form the image on the second surface, and the duplex sensor detects when the paper is caught in the duplex rollers and outputs a signal in response to the detection, wherein the paper discharge part includes a driving unit which has driving rollers and driven rollers to reversely feed the paper printed on the first surface to the duplex printing part and to discharge the paper printed on the first and second surfaces, and a separation unit to receive the signal from the duplex sensor and to separate the driven rollers and the driving rollers from each other in response to the received signal.

2. The duplex image forming apparatus according to claim 1, wherein:

the paper discharge part further includes a first supporting frame to which the driving rollers are mounted, and a second supporting frame which is provided below the first supporting frame and to which the driven rollers are mounted; and the first supporting frame and the second supporting frame provide a paper feeding path therebetween.

3. The duplex image forming apparatus according to claim 2, wherein:

the separation unit includes a cam member which is provided underneath the second supporting frame, a rotating shaft which is connected to the cam member, and a rotating motor which rotates the rotating shaft; and the second supporting frame pivots by the separation unit so that the driven rollers are separated from the driving rollers.

4. The duplex image forming apparatus according to claim 3, wherein the second supporting frame is hingedly coupled to the first supporting frame so as to pivot when the cam member rotates.

5. The duplex image forming apparatus according to claim 3, wherein:

the rotating motor of the separation unit operates in response to the received signal.

6. The duplex image forming apparatus according to claim 2, wherein:

the separation unit includes a cam member which is provided underneath the second supporting frame, a rotating shaft which is connected to the cam member, and a gear member provided to be connected to the rotating shaft and receiving rotational force of a driving source which drives overall the image forming part, the paper discharge part and the duplex printing part; and the second supporting frame pivots by the separation unit so that the driven rollers are separated from the driving rollers.

7. A duplex image forming apparatus, comprising:

an image forming part which forms an image on a first paper having a first size and a second paper having a second size;

a paper discharge part disposed in a first position to fully discharge the first paper and the second paper outside the duplex image forming apparatus in a discharging direction and to feed the first paper and the second paper in a reverse direction; and a duplex printing part to receive the first paper and the second paper from the paper discharge part in the reverse direction, and to register the first paper and the second paper when feeding the first paper and the second paper toward the image forming part, the duplex printing part comprising:

duplex rollers; and a duplex sensor to detect when a leading portion of the first paper or the second paper are caught and registered by the duplex rollers and to output a signal in response to the detection, the duplex rollers being located upstream of the duplex sensor, wherein the paper discharge part receives the signal from the duplex sensor and moves to a second position from the first position not to feed the first paper in the reverse direction in response to the received signal when the first paper is registered by the duplex printing part, and does not move to the second position in response to the received signal when the second paper is registered by the duplex printing part.

8. The duplex image forming apparatus according to claim 7, wherein the first size is longer than the first size in the reverse direction.

9. The duplex image forming apparatus according to claim 7, wherein:

the paper discharge part comprises a driving roller to feed the first paper and the second paper in the reverse direction;

the duplex printing part comprises a register roller to register the first paper and the second paper during feeding the first paper and the second paper to the image forming part; and the driving roller is spaced-apart from the register roller by a distance different from the first size and the second size.

10. The duplex image forming apparatus according to claim 7, wherein the paper discharge part does not catch the first paper and the second paper when the duplex printing part registers the first paper and the second paper.

* * * * *